US006829808B2

(12) United States Patent
Neukötter

(10) Patent No.: US 6,829,808 B2
(45) Date of Patent: Dec. 14, 2004

(54) DOOR HINGE FOR A COVERED ARRANGEMENT BETWEEN DOOR POST AND DOOR

(75) Inventor: Hubert Neukötter, Beelen (DE)

(73) Assignee: Simonswerk, Gesellschaft mit beschränkter Haftung, Rheda-Wiedenbrück (DE)

( * ) Notice: Subject to any disclaimer, the term of this patent is extended or adjusted under 35 U.S.C. 154(b) by 61 days.

(21) Appl. No.: 10/284,020

(22) Filed: Oct. 30, 2002

(65) Prior Publication Data

US 2003/0088943 A1 May 15, 2003

(30) Foreign Application Priority Data

| | | |
|---|---|---|
| Oct. 31, 2001 | (DE) | 101 53 778 |
| Jun. 20, 2002 | (DE) | 102 27 638 |
| Aug. 28, 2002 | (DE) | 202 13 155 |

(51) Int. Cl.[7] ..... E05D 3/06
(52) U.S. Cl. ..... 16/366
(58) Field of Search ..... 16/237–240, 242, 16/245, 337, 338, 270, 366, 368–370, DIG. 13, DIG. 34

(56) References Cited

U.S. PATENT DOCUMENTS

| | | | | | |
|---|---|---|---|---|---|
| 1,554,161 | A | * | 9/1925 | Hubbard | 16/368 |
| 1,797,802 | A | * | 3/1931 | Soss | 16/369 |
| 2,001,356 | A | | 5/1935 | Bates | |
| 2,021,702 | A | * | 11/1935 | Soss | 16/369 |
| 2,135,280 | A | * | 11/1938 | Erickson | 16/369 |
| 2,248,372 | A | * | 7/1941 | May | 16/240 |
| 2,694,216 | A | * | 11/1954 | Schnur | 16/369 |
| 4,780,929 | A | | 11/1988 | Burns et al. | |
| 5,044,044 | A | * | 9/1991 | Young et al. | 16/323 |
| 5,339,493 | A | * | 8/1994 | MacIntyre | 16/238 |
| 5,713,105 | A | * | 2/1998 | Toomey | 16/245 |
| 6,202,255 | B1 | * | 3/2001 | Sitter | 16/242 |
| 6,487,755 | B1 | * | 12/2002 | Caldari | 16/370 |
| 6,516,494 | B2 | * | 2/2003 | Nakamoto et al. | 16/271 |

FOREIGN PATENT DOCUMENTS

| | | | |
|---|---|---|---|
| CN | 409764 | | 10/2000 |
| CN | 493684 | | 7/2002 |
| EP | 1 063 376 | | 12/2000 |
| GB | 2032994 A | * | 5/1980 |
| JP | 05-71261 | * | 3/1993 |

* cited by examiner

*Primary Examiner*—Robert J. Sandy
*Assistant Examiner*—Andre'L. Jackson
(74) *Attorney, Agent, or Firm*—Collard & Roe, P.C.

(57) ABSTRACT

A hidden hinge system for furniture and doors has recessed mountings in the fixed frame and movable frame and linked by two interlocking hinge brackets to operate as a lift off hinge. One hinge bracket has a forked shape while the second hinge bracket has a central flange which fits into the forked shape enabling the hinge to occupy a compact space. The separate mountings have alignment adjustments to hang the door.

11 Claims, 10 Drawing Sheets

DOOR HINGE FOR A COVERED ARRANGEMENT BETWEEN DOOR POST AND DOOR

CROSS REFERENCE TO RELATED APPLICATIONS

Applicant claims priority under 35 U.S.C. §119 of German Application No. 101 53 778.6, filed Oct. 31, 2001, No. 102 27 638.2, filed Jun. 20, 2002, and No. 202 13 155.6, filed Aug. 28, 2002.

BACKGROUND OF THE INVENTION

1. Field of the Invention

The present invention relates to a hidden hinge or door strip for a covered arrangement between the fixed or stationary door post or frame and the wing or leaf of a door. The hinge includes two receiving bodies or mounting bases, hinge brackets, and connectors or inserts. The two mounting bases can be inserted into recesses in the door post and in the narrow side or edge of the door. The hinge brackets interact in pairs and are connected so as to move in pivot fashion about a vertical axis of rotation. The connectors are arranged in the mounting bases and each connector supports the end of a hinge bracket so as to be capable of pivoting about a vertical axis or rotation. The end of the other hinge bracket is guided, capable of movement both longitudinally and in pivot fashion. The door post can be designed as a door lining, block frame or steel frame.

2. The Prior Art

A door post of the structure described above is known from EP 1 063,376 A2. With this known design, the hinge brackets each extend by half over the vertical section of the door hinge. In order to adjust the height of the door wing or leaf, the distance between the hinge brackets can be changed. For this purpose, the axis of rotation between the hinge brackets is designed as an adjusting spindle. The dimensional stability of the known arrangement calls for improvement. The known door hinge is suitable for installation in lightweight door wings, for example, for pieces of furniture, but appears less suitable for doors in residential situations.

A similar design is described in U.S. Pat. No. 4,780,929, specifically for lightweight objects of use, such as skis and musical instruments that can be folded together for easier stowing.

SUMMARY OF THE INVENTION

The invention provides a door hinge for doors in residential rooms or situations that is covered (or hidden) in its installed condition. This hinge is characterized by high dimensional stability and it is suitable for heavy doors. In particular, precise adjustments of the door relative to the door post should be possible.

In accordance with the invention, a hinge with the features described above has one of the two hinge brackets designed in the shape of a fork with two fork arms connecting to a rearward connecting section. This connecting section and the fork arms are mounted on the connectors. The other hinge bracket is inserted in the clear (or free) space between the fork arms. The second hinge bracket includes a middle element mounted in rotational fashion on the fork arms, connected to which at both ends by broader end segments of the bracket. The end segments project upwards and downwards and are mounted on the connectors on the top and bottom sides. The hinge brackets extend in the vertical direction to the same level of height. The upper faces of the two hinge brackets are aligned or flush with each other and the lower faces of the hinge brackets are aligned with each other as well, so that the entire vertical area of the hinge is used to form the jointed connection between the hinge brackets. The hinge brackets, which interact in pairs, are designed as dimensionally stable connecting elements. A contributory factor to the dimensional stability of the arrangement according to the invention is that the hinge brackets in each case extend in each case at both connection ends directly as far as the connectors arranged in the mounting bases. In this way, the mounting can be effected on short journals or lugs which bridge only a small interval gap. With the arrangement of the hinge according to the invention, it is not possible to reach into the door gap from one side during opening and closing of the door. Therefore, the hinge also complies with high safety requirements.

Each of the connectors has a hinge pin or journal, or a journal receptacle or mount, for supporting a hinge bracket in a rotationally movable manner, as well as a guide groove for the linear guidance of the other hinge bracket. The journals which are guided in the guide grooves are usefully provided with plastic sleeves that assure smooth running of the hinge journals in the guides.

According to a preferred embodiment of the invention, the connectors are arranged in the mounting bases so that they can be adjusted both vertically and horizontally. The connectors of the first mounting base are usefully arranged in a guiding recess of the mounting base so that they can be vertically adjustable. The connectors of the second mounting member are orthogonally adjustable to the front face, i.e. they are capable of movement into or out of the mounting base. With the arrangement described, the bearing connectors can be adjusted in at least two axial directions.

With the embodiments described hereinafter, it is also possible to make adjustments at the bearing connectors in three axial directions X, Y and Z. In this context, there are a number of possibilities for the structural design. According to a first embodiment, eccentric adjustment elements are arranged in the first mounting base for the vertical and/or horizontal adjustment of the connectors. Both connectors of the mounting base preferably have an eccentric adjustment element for the horizontal adjustment. The lower connector of the mounting base is additionally supported on an eccentric adjustment element that is rotationally mounted in the mounting base and serves to provide for vertical or height adjustments. The eccentric elements for horizontal adjustment are preferably arranged for rotational movement on a set screw inserted in a threaded drilled hole (or bore) of the mounting base, and engage an eccentric receptacle or mounting of the associated connector. By tightening the set screw, the eccentric element can be secured in any desired adjusted position on the insert. The second mounting base has adjusting spindles that are mounted so as to be rotationally movable on the rear face of the mounting base and extend through threaded holes in the connector. By actuating the setting spindles, which are accessible from the front face, the connectors arranged in the second mounting base perform orthogonal setting movements toward the front face or a fastening flange located on the front face respectively.

In a second, alternative embodiment, the bearing connectors of the first mounting base are arranged so that they can be adjusted only vertically. An adjustable eccentric element may be provided for the vertical adjusting movement. After the desired position has been set, the bearing connectors can be fixed to the mounting base, for example by means of a fastening screw. The bearing connectors of the second mounting base can be adjusted in two axial directions. These bearing connectors are horizontally adjustably arranged in a guiding recess of the mounting base and, additionally contain threaded holes into which adjusting spindles are inserted. These spindles are rotationally movable and horizontally displaceable on the rear face of the mounting base. By means of the setting spindles, which are retained on the rear face of the mounting base so as to be rotationally movable and horizontally displaceable, the connectors can be moved into the mounting base or moved out of it again.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
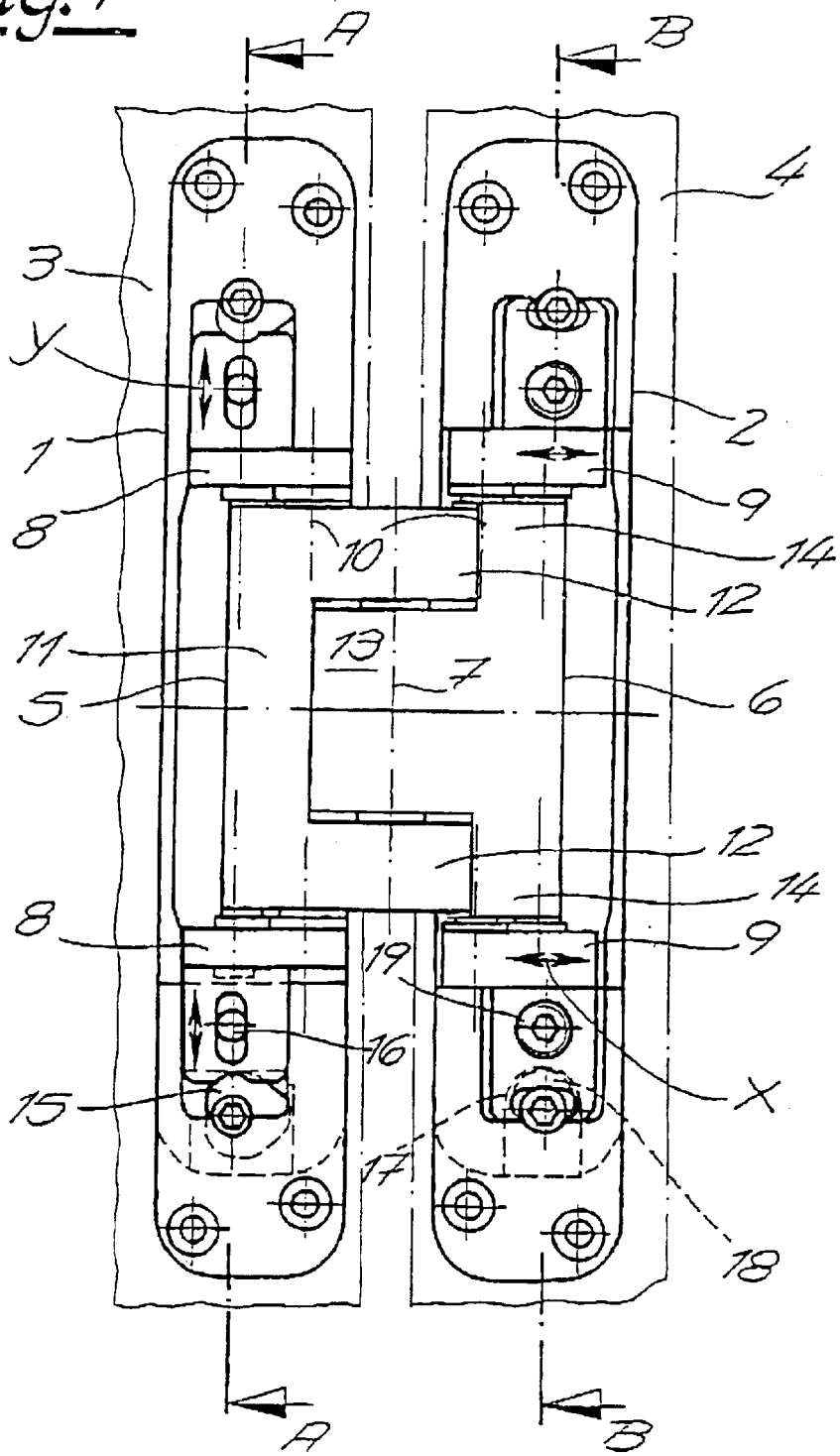
FIG. 1 shows a door hinge for a covered (or hidden) arrangement between door post and door wing.
Figure 2A:
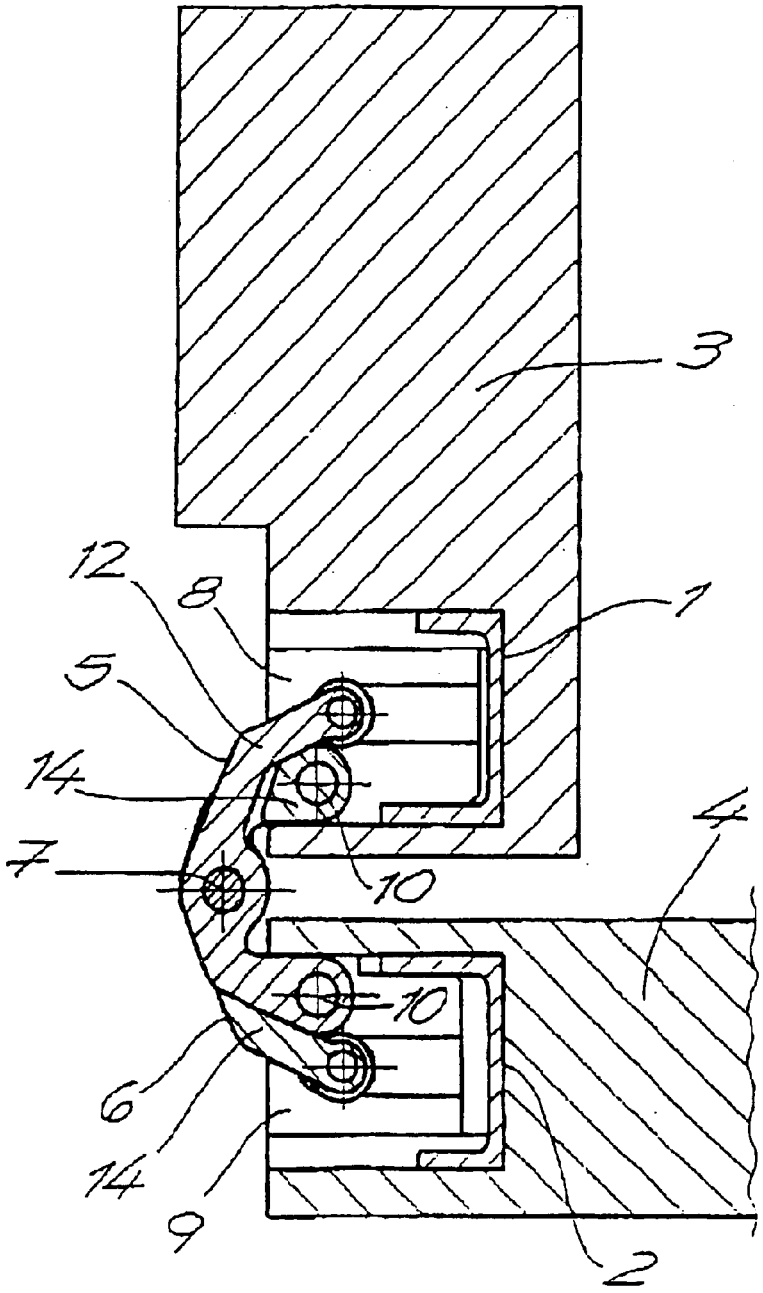
FIG. 2*a* is a plan view of the door hinge shown in FIG. 1, with the door opened.
Figure 2B:
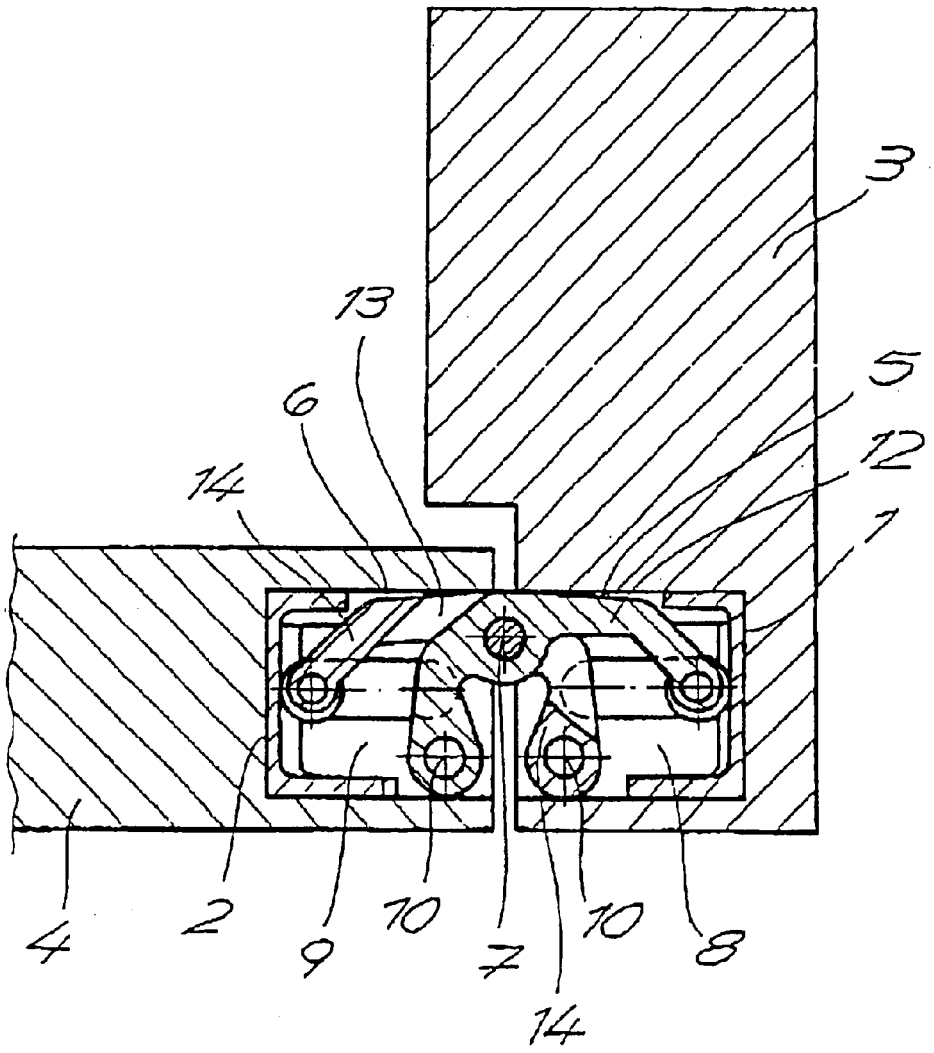
FIG. 2*b* is a plan view of the door hinge shown in FIG. 1, with the door closed.
Figure 3:
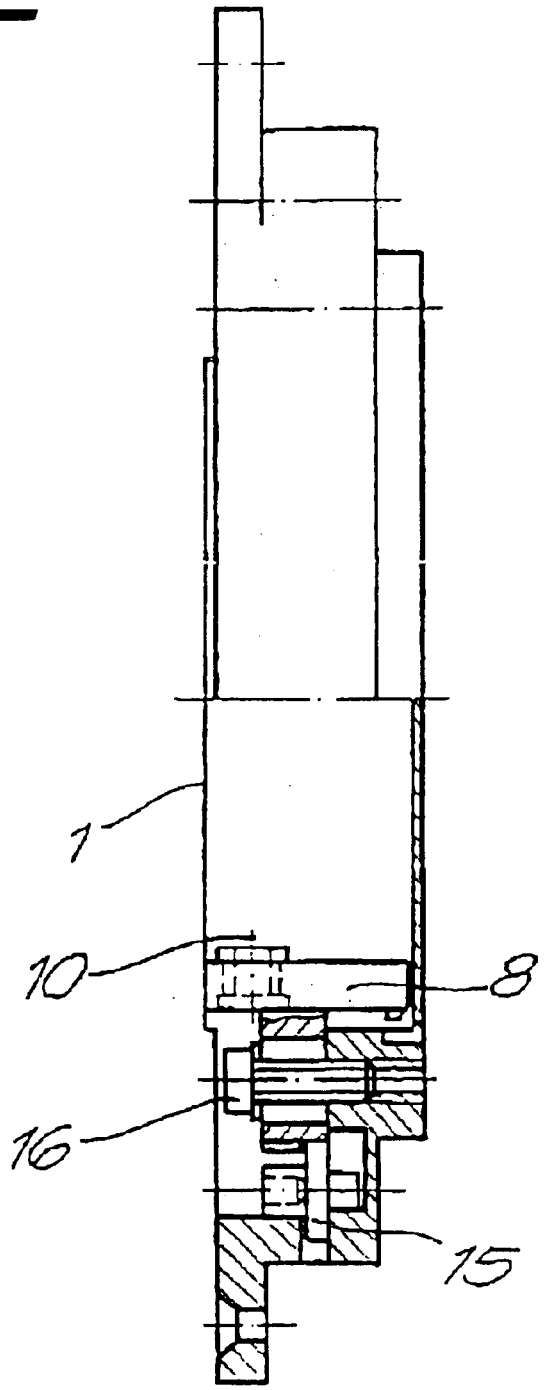
FIG. 3 is a longitudinal section through the mounting base of the door hinge shown in FIG. 1 in the sectional plane A—A, shown by a cutout.

Referring now to the drawings, the door hinge shown pivotally secures a door to a door post. When the door is closed, the door hinge is arranged in a covered (or hidden) manner. This door hinge is suitable for heavy doors and is particularly intended for the doors of rooms and the front doors of apartments and residential houses.

The basic structure of the door hinge shown in the figures includes two mounting bases 1, 2, which can be inserted into recesses in the door post 3 and in the narrow side of the door or door wing 4; the two hinge brackets 5 and 6 that cooperate with each other in pairs and are connected so that they can be pivoted around a vertical axis of rotation 7; and the inserts or connectors 8 and 9, which are arranged in the mounting bases 1 and 2. On each of both connectors 8, 9 the end of a hinge bracket is mounted so as to be capable of pivoting about a vertical axis of rotation 10 and the end of the other hinge bracket is guided for longitudinal movement. That means that each hinge bracket is arranged rotatably about a vertical axis 10 on one end and is guided for longitudinal movement on the other end.

As shown in FIG. 1, one of the two hinge brackets 5 has the shape of a fork with the two fork arms 12 connecting at a connecting section 11. Connecting section 11 and fork arms 12 are connected to connectors 8 and 9, each having upper and lower parts. The other hinge bracket 6 is inserted in the clear (or free) space between the fork arms 12, and has a middle element 13 that is rotationally movable at the fork arms. The middle piece is adjoined at both ends by the wider end segments 14 of the bracket, projecting upwards and downwards. End segments 14 are also connected to connectors 8 and 9 both on the upper and lower faces. The arrangement including hinge brackets 5 and 6, which engage one another, is characterized by high dimensional stability. Plastic sleeves are arranged on the axis of rotation 7 connecting hinge brackets 5 and 6, as well as on journals (or lugs) which engage bearing holes and guiding grooves of connectors 8 and 9. The bearings operate free of maintenance.

Connectors 8 and 9 provided on mounting bases 1 and 2 are adjustable. By adjusting connectors 8 and 9, the door can be adjusted in up to the three axial directions X, Y and Z. Connectors 8 of first mounting base 1 are arranged in a guiding recess of the mounting base 1, so as to be vertically adjustable. In this way, door 4 attached to the door hinge can be adjusted in its height, i.e. vertically. For precise vertical adjustment, in the embodiment of FIG. 1 an eccentric adjustment element 15 is provided, which is rotationally mounted about an eccentric axis at mounting base 1. Once connectors 8 have been adjusted, they can be fixed in place on mounting base 1 by means of screws 16 (FIG. 1). Screws 16 pass through oblong holes in the connector and are screwed into threaded holes on the rear face of mounting base 1.

With the embodiment of the door hinge shown in FIG. 1, connectors 9 of second mounting base 2 are arranged in a horizontally adjustable manner in a guiding recess of the mounting base, and have a recess 17 that is engaged by an eccentric adjustment element 18 mounted on mounting base 2. Eccentric adjustment element 18 permits precise horizontal adjustments of connectors 9. In this way, errors in the flush alignment between the door 4 and the door post 3 in the closed state can be corrected, and the pressure with which door 4 rests against the seal of the post or frame when the door is in the closed condition, can be adjusted as well.

Figure 4:
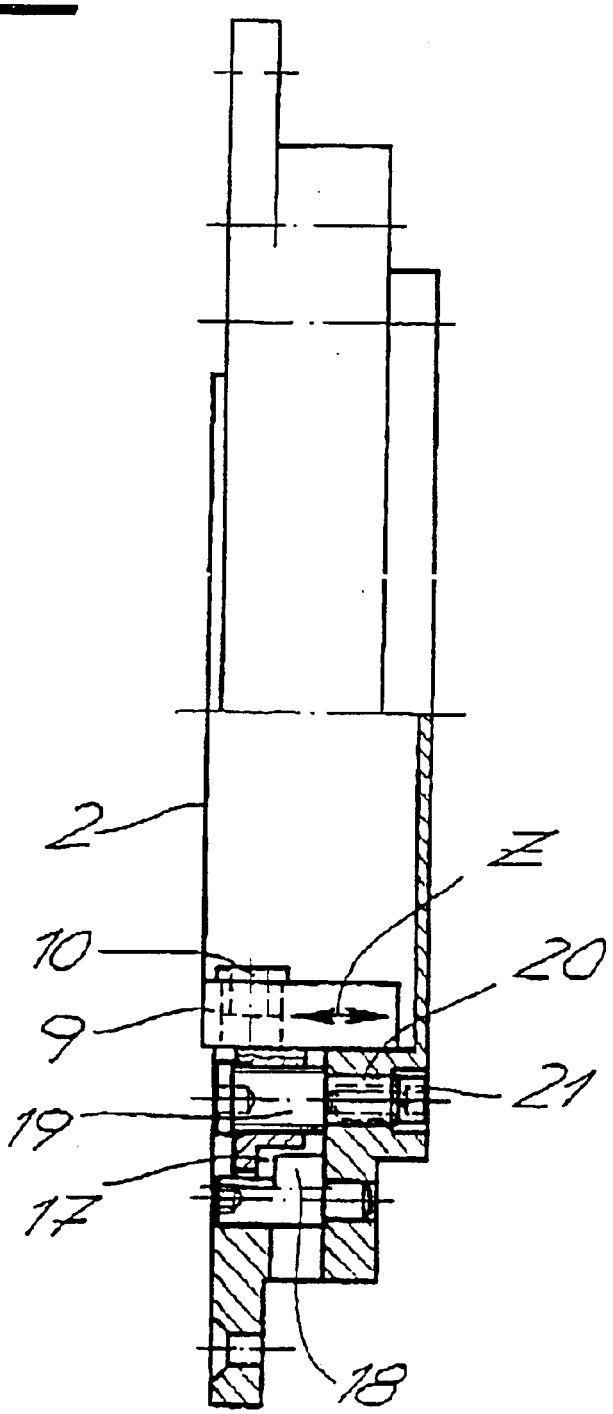
FIG. 4 is a longitudinal section through the mounting base of the door hinge shown in FIG. 1 in the sectional plane B—B, shown by a cutout.

Connectors 9 of second mounting base 2 further contain threaded holes in which adjustment screws 19 are inserted. Adjustment screws 19 are retained on the rear face of mounting base 2 so that they can be rotated and displaced horizontally. A comparative view of FIGS. 1 and 4 shows that the rear face of mounting base 2 contains a longitudinal hole through which passes a journal-shaped extension piece 20 of adjustment screw 19. Inserted into the extension piece is a safety or locking screw 21. By actuating the adjustment screws 19, connectors 9 can be moved further into mounting base 2 or out of it. As a result, lateral adjustments of door 4 are possible.

Figure 5:
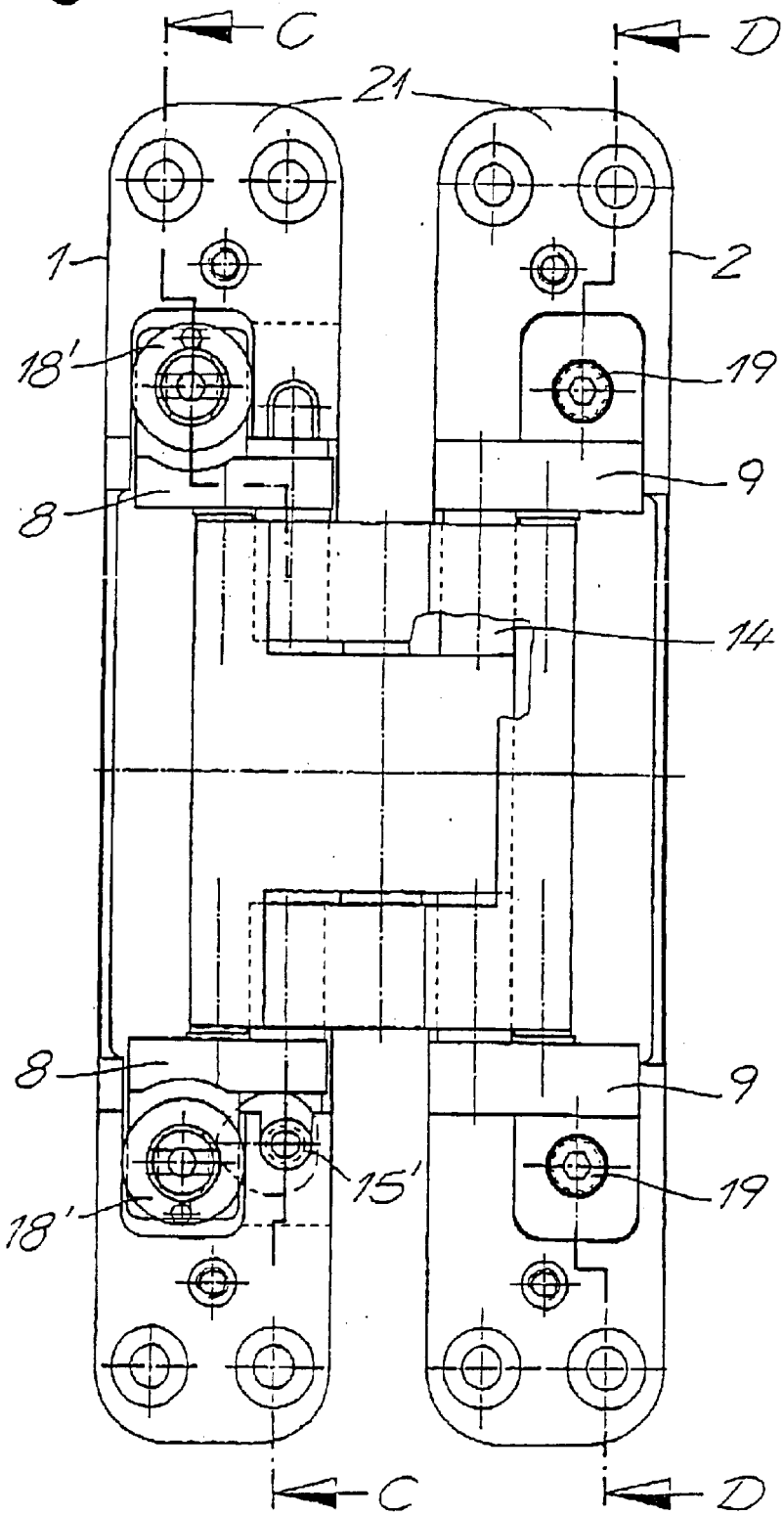
FIG. 5 shows another embodiment of the object represented in FIG. 1.
Figure 6:
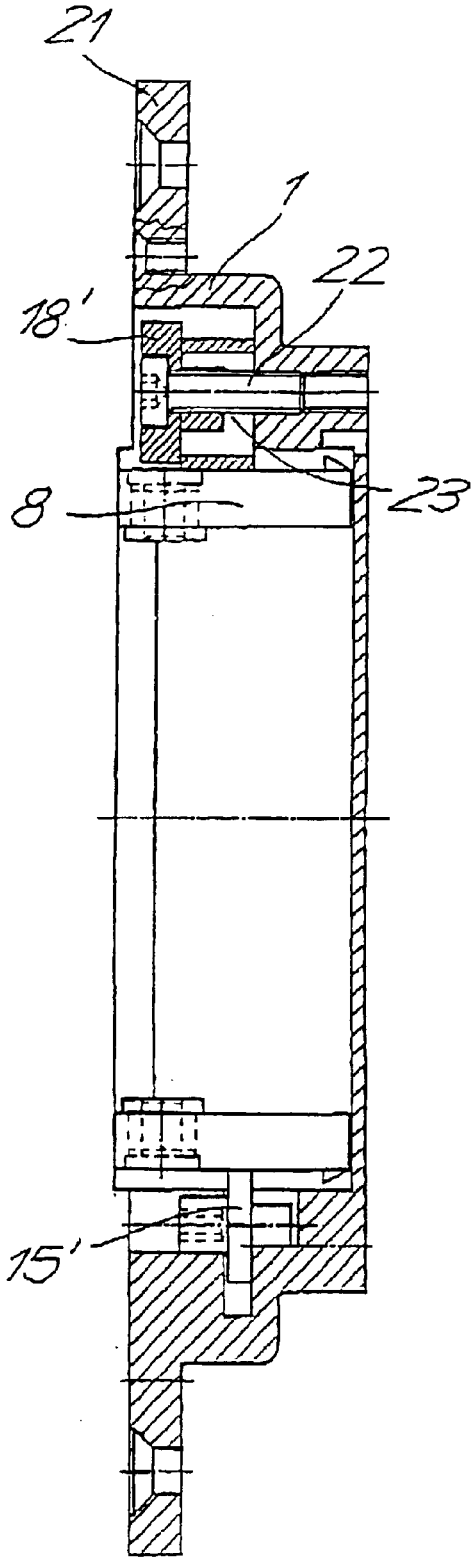
FIG. 6 is a longitudinal section through the object of FIG. 5 in the sectional plane C—C.
Figure 7:
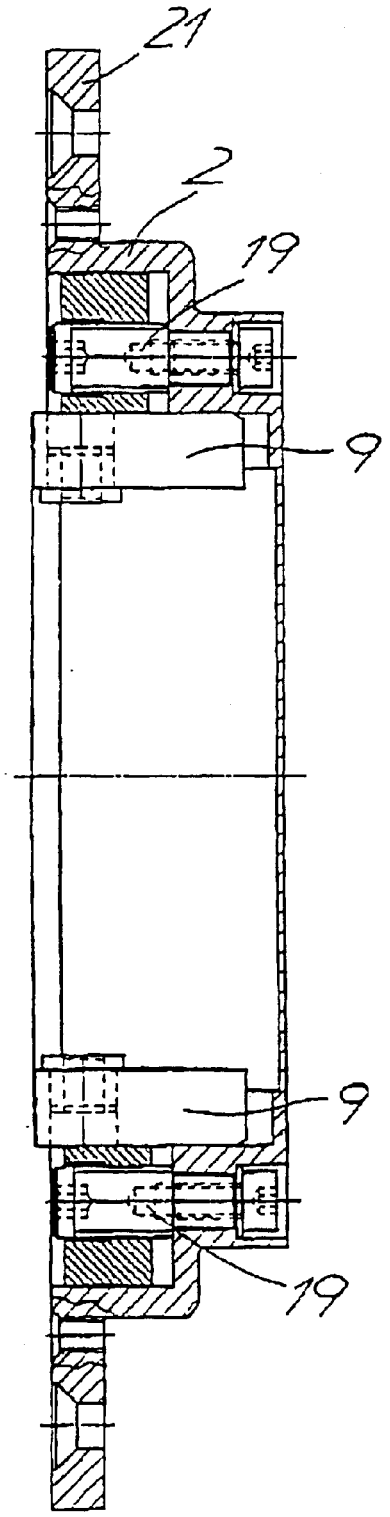
FIG. 7 is a longitudinal section through the object of FIG. 5 in the sectional plane D—D.

With the embodiment of the invention shown in FIGS. 5 to 7, connectors 8 of first mounting base 1 are arranged in a guiding recess of the mounting base so that they are capable of both vertical and horizontal adjustment, whereas connectors 9 of second mounting base 2 can be adjusted only orthogonally to a front-face fastening flange 21, and can be moved by the adjustment screws 19 further into the mounting base or out of it. Both connectors 8 of first mounting base 1 have an eccentric adjustment element 18' for horizontal adjustments. The eccentric adjustment element is arranged in a rotational movable manner on a set screw 22 that is inserted in a threaded hole of mounting base 1, and engages an eccentric mounting 23 of the associated connector 8. By tightening set screws 22, the eccentric element 18' can be fixed on the associated connector 8 in any desired adjustment position, with the insert clamped against the mounting base.

As shown in FIG. 5, lower connector 8 of mounting base 1 is supported on an eccentric adjustment element 15' that is rotationally mounted in mounting base 1 and serves to provide the vertical adjustments. Second mounting base 2 has adjustment screws 19 which are mounted on the rear face of the mounting base 2 in a rotatably movable manner and pass through threaded holes in connectors 9. By actuating adjustment screws 19, which are accessible from the front face, connectors 9 can be adjusted further into mounting base 2 or out of it.

By adjusting connectors 8, 9 in the door hinge embodiment shown in FIGS. 5 to 7, the door is likewise adjustable in three axial directions X, Y and Z. By virtue of the adjustment possibilities available on first mounting base 1 (FIG. 5), adjustments to the door can be made with respect to its level (or height), and flush alignment errors between the door and the door post in the closed condition can be corrected. With the adjustment possibility provided on second mounting base 2, lateral adjustments to the door are possible. All adjustments can be made from the front side and can therefore be performed with the door hinge installed.

Figure 8:
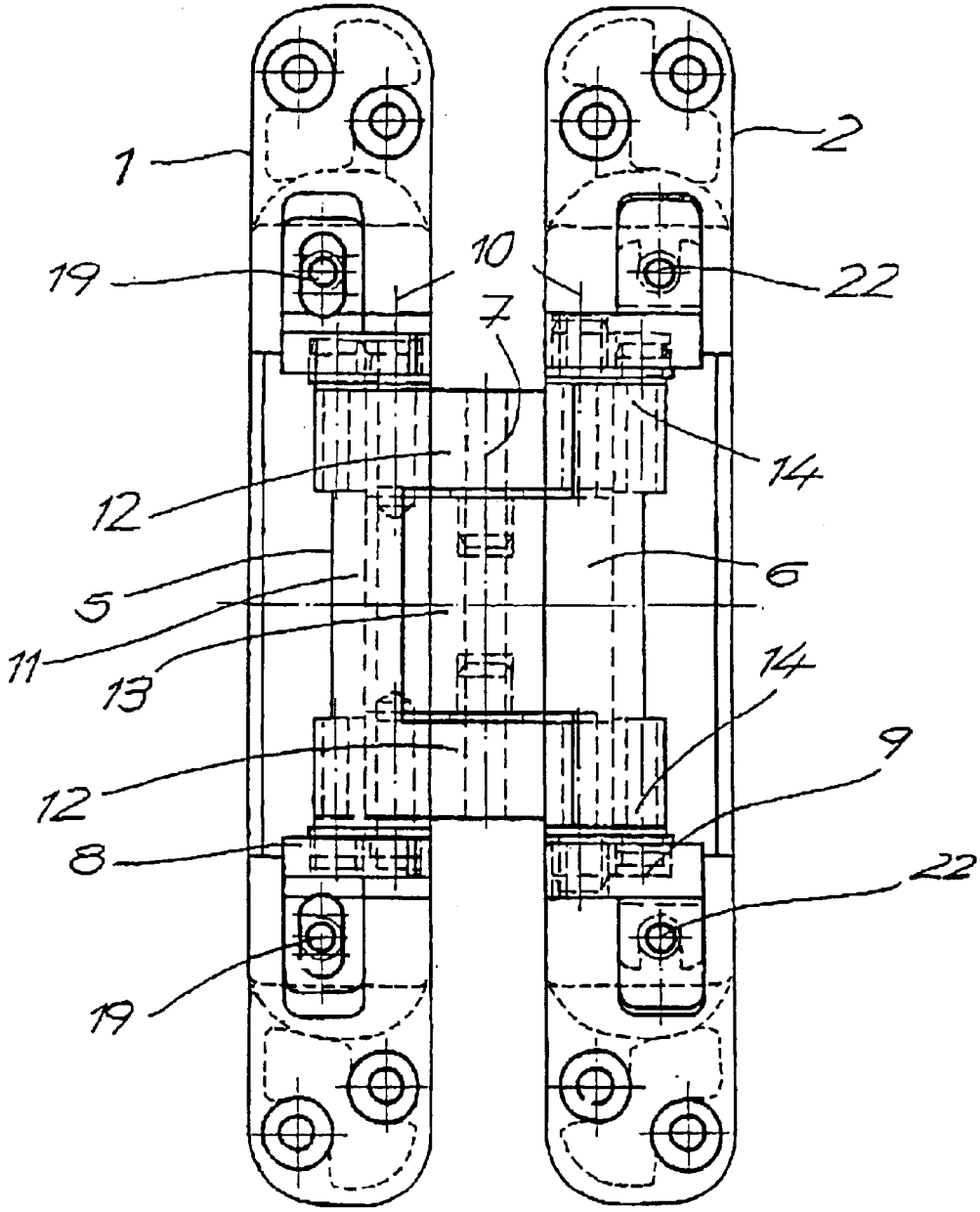
FIG. 8 shows another embodiment of the door hinge.

With the embodiment shown in FIG. 8, an upper vertical adjusting element and, opposite this element, a lower vertical adjustment element, are arranged as connectors or inserts in the post-side of the mounting base. These connectors each have an oblong or longitudinal hole extending in the vertical direction, through which a clamping screw passes. For the correct vertical positioning of the door, the vertical adjustment elements are first brought into the desired position before they are fixed in the desired position by means of clamping screws 19. In a similar manner, an upper horizontal adjustment element and a lower horizontal adjustment element are arranged as connectors in the door-side receiving or mounting part. Set screws 22 pass through these two horizontal adjustment elements by means of which they are in a threaded connection. By rotation of the set screws, the two horizontal adjustment elements can be adjusted in relation to the door-side mounting base in the horizontal transverse direction of the door, with the door closed. Accordingly, the door can be fixed in the desired position in its width direction in relation to the door post.

Figure 9:
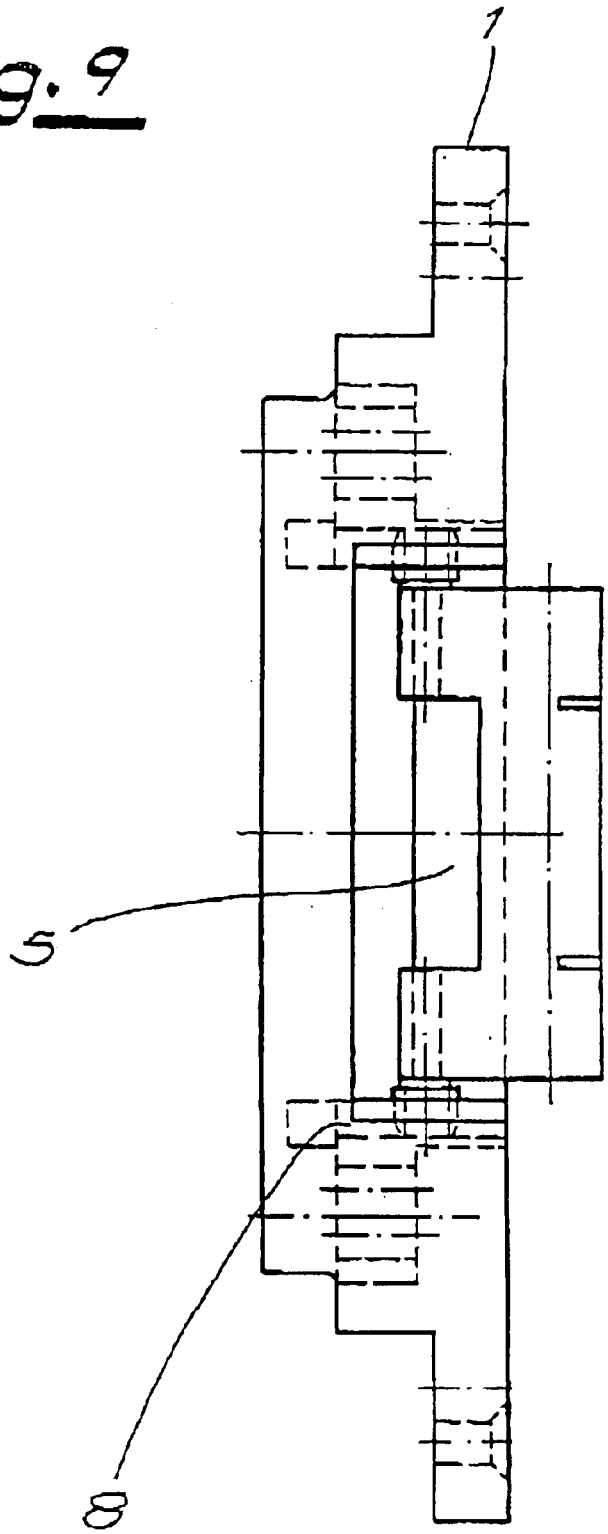
FIG. 9 is a side view of a fork-shaped hinge bracket of the door hinge represented in FIG. 8.

As shown in FIG. 9, mounted on the connectors in each case is the end of a hinge bracket, capable of pivoting about a vertical axis of rotation, and the end of the other hinge bracket is guided in longitudinal movement. For the longitudinal movement guidance, sliding guides in the form of longitudinal holes are provided in the connectors, into which hinged journals engage, which are connected with the respective hinge brackets. To facilitate the movement of the hinged journals in the longitudinal hole sliding guides, each hinged journal can be fitted with a plastic sleeve mounted on its segment engaging the respective longitudinal hole sliding guide.

As shown in FIG. 8, the hinge brackets are connected so as to pivot about a vertical axis of rotation. The axis of rotation is formed by a hinge journal, which engages through the hinge sleeves of the hinge brackets that are aligned flush with each other. In this situation, the hinge journal may also be designed as a two-section element, as shown in FIG. 8.

The hinge brackets that are connected about a vertical axis of rotation extend in the vertical direction over the same height. The upper faces of the hinge brackets and the lower faces of the hinge brackets are flush with each other, so that the entire vertical area of the door hinge is used to provide a jointed or articulated connection between the hinge brackets.

While only a few embodiments of the present invention has been shown and described, it is to be understood that many changes and modifications may be made thereunto without departing from the spirit and scope of the invention as defined in the appended claims.

What is claimed is:

1. A hinge for hidden installation between a door post and a door, both having recesses formed therein, comprising (a) first and second mounting bases for insertion in recesses in the door post and in the door;

(b) at least two connectors disposed on surfaces of said mounting bases, wherein the connectors arranged in the first mounting base are adjustably arranged in a guiding recess in a vertical or horizontal direction, and the connectors arranged in the second mounting base are arranged so as to be adjustable orthogonally in relation to a front face of said hinge;

(c) a first hinge bracket comprising first and second fork arms defining an open space and an integrally-formed adjourning rearward connecting section connecting said fork arms, said connecting section and said fork arms being mounted on said connectors; and (d) a second hinge bracket comprising a middle element and integrally-formed first and second end segments connected to and projecting upwards and downwards respectively from each end of said middle element, said middle element being inserted in said open space and being rotatably mounted on said fork arms, said first and second hinge brackets cooperating with and pivotally connected to each other for movement about a first vertical axis of rotation, said first hinge bracket having an end segment mounted on the first mounting base so as to pivot about a second vertical axis of rotation and having another end segment guided for longitudinal movement on the second mounting base, said end segment of said second hinge bracket being mounted on the second mounting base so as to pivot about a second vertical axis of rotation and said second end segment of said second hinge bracket being guided for longitudinal movement on the first mounting base, said connectors having upper and lower parts, supporting said end segments, and said hinge brackets extending vertically over a same level of height.

2. A hinge for hidden installation between a door post and a door, both having recesses formed therein, comprising (a) first and second mounting bases for insertion in recesses in the door post and in the door, said mounting bases having guiding recesses;

(b) at least two connectors disposed on surfaces of said mounting bases and arranged in the guiding recesses in an adjustable manner;

(c) eccentric adjustment elements arranged in said first mounting base for vertical or horizontal adjustments of the connectors arranged in said first mounting base;

(d) a first hinge bracket comprising first and second fork arms defining an open space and an integrallly-formed adjourning rearward connecting section connecting said fork arms, said connecting section and said fork arms being mounted on said connectors; and (e) a second hinge bracket comprising a middle element and integrally-formed first and second end segments connected to and projecting upwards and downwards respectively from each end of said middle element, said middle element being inserted in said open space and being rotatably mounted on said fork arms, said first and second hinge brackets cooperating with and pivotally connected to each other f or movement about a first vertical axis of rotation, said first hinge bracket having an end segment mounted on the first mounting base so as to pivot about a second vertical axis of rotation and having another end segment guided for longitudinal movement on the second mounting base, said first end segment of said second hinge bracket being mounted on the second mounting base so as to pivot about a second vertical axis of rotation and said second end segment of said second hinge bracket being guided for longitudinal movement on the first mounting base, said connectors having upper and lower parts, supporting said end segments, and said hinge brackets extending vertically over a same level of height.

3. The hinge according to claim 2, further comprising a set screw inserted in a threaded hole of said first mounting base and wherein a first eccentric element of said eccentric elements is a horizontal adjustment element arranged for rotational movement on said set screw, said first eccentric element engaging into an eccentric receptacle mount of an associated connector and being secured at the associated connector in any desired adjustment position by the set screw.

4. The hinge according to claim 2, wherein upper and lower connectors are arranged in said first mounting base, said upper and lower connectors have respective first and second eccentric adjustment elements for horizontal adjustment, and wherein said hinge further comprises a third eccentric adjustment element rotationally mounted in said first mounting base and supporting said lower connector for vertical adjustments of said lower connector.

5. A hinge for hidden installation between a door post and a door, both having recesses formed therein, comprising (a) first and second mounting bases for insertion in recesses in the door post and in the door, said second mounting base having a guiding recess and adjustment screws retained on a rear face of said second mounting base in a rotationally movable manner and capable of horizontal displacement;

(b) at least two connectors disposed on surfaces of said mounting bases, the connectors arranged in said second mounting base being arranged in said guiding recess so as to be horizontally mounted and containing threaded holes into which said adjustment screws are inserted;

(c) a first hinge bracket comprising first and second fork arms defining an open space and an integrally-formed adjourning rearward connecting section connecting said fork arms, said connecting section and said fork arms being mounted on said connectors; and (d) a second hinge bracket comprising a middle element and integrally-formed first and second end segments connected to and projecting upwards and downwards respectively from each end of said middle element, said middle element being inserted in said open space and being rotatably mounted on said fork arms, said first and second hinge brackets cooperating with and pivotally connected to each other for movement about a first vertical axis of rotation, said first hinge bracket having an end segment mounted on the first mounting base so as to pivot about a second vertical axis of rotation and having another end segment guided for longitudinal movement on the second mounting base, said first end segment of said second hinge bracket being mounted on the second mounting base so as to pivot about a second vertical axis of rotation and said second end segment of said second hinge bracket being guided for longitudinal movement on the first mounting base, said connectors having upper and lower parts, supporting said end segments, and said hinge brackets extending vertically over a same level of height.

6. The hinge according to claim 5, wherein each of said adjustment screws has a journal-shaped extension and the rear face of said second mounting base contains longitudinal holes through which a respective one of said journal-shaped extensions passes.

7. The hinge according to claim 5, further comprising an eccentric adjustment element arranged in said second mounting base for horizontal adjustment of the connectors associated with said second mounting base.

8. A hinge for hidden installation between a door post and a door, both having recesses formed therein, comprising (a) first and second mounting bases for insertion in recesses in the door post and in the door, said second mounting base having adjustment screws mounted so as to be rotationally movable on a rear face of said second mounting base;

(b) at least two connectors disposed on surfaces of said mounting bases, the connectors arranged in said second mounting base having threaded holes through which said adjustment screws extend;

(c) a first hinge bracket comprising first and second fork arms defining an open space and an integrally-formed adjourning rearward connecting section connecting said fork arms, said connecting section and said fork arms being mounted on said connectors; and (d) a second hinge bracket comprising a middle element and integrally-formed first and second end segments connected to and projecting upwards and downwards respectively from each end of said middle element, said middle element being inserted in said open space and being rotatably mounted on said fork arms, said first and second hinge brackets cooperating with and pivotally connected to each other for movement about a first vertical axis of rotation, said first hinge bracket having an end segment mounted on the first mounting base so as to pivot about a second vertical axis of rotation and having another end segment guided for longitudinal movement on the second mounting base, said first end segment of said second hinge bracket being mounted on the second mounting base so as to pivot about a second vertical axis of rotation and said second end segment of said second hinge bracket being guided for longitudinal movement on the first mounting base, said connectors having upper and lower parts, supporting said end segments, and said hinge brackets extending vertically over a same level of height.

9. A hinge for hidden installation between a door post and a door, both having recesses formed therein, comprising a) first and second mounting bases for insertion in recesses in the door post and in the door;

b) at least two connectors disposed on surfaces of said mounting bases;

c) a first hinge bracket comprising first and second fork arms defining an open space and an integrally-formed adjourning rearward connecting section connecting said fork arms, said connecting section and said fork arms being mounted on said connectors; and d) a second hinge bracket comprising a middle element and integrally-formed first and second end segments connected to and projecting upwards and downwards respectively from each end of said middle element, said first and second end segments being mounted on said connectors on the top and bottom sides, said middle element being inserted in said open space and being rotatably mounted on said fork arms, said first and second hinge brackets cooperating with and pivotally connected to each other for movement about a first vertical axis of rotation, said first hinge bracket having an end segment mounted on the first mounting base so as to pivot about a second vertical axis of rotation and having another end segment guided for longitudinal movement on the second mounting base, said first end segment of said second hinge bracket being mounted on the second mounting base so as to pivot about a second vertical axis of rotation and said second end segment of said second hinge bracket being guided for longitudinal movement on the first mounting base, said connectors having upper and lower parts, supporting said end segments, and said hinge brackets extending vertically over a same level of height.

10. The hinge according to claim 9, wherein each of said connectors comprises a journal or a journal receptacle mounting for supporting a respective one of said hinge brackets for rotational movement, and a guide groove for linear guidance of the other hinge bracket.

11. The hinge according to claim 9, wherein the mounting bases have guiding recesses in which the connectors are arranged in an adjustable manner.

* * * * *

UNITED STATES PATENT AND TRADEMARK OFFICE

CERTIFICATE OF CORRECTION

PATENT NO. : 6,829,808 B2
DATED : December 14, 2004
INVENTOR(S) : Neukötter-1

It is certified that error appears in the above-identified patent and that said Letters Patent is hereby corrected as shown below:

Column 6,
Line 43, please change “said end segment” to correctly read -- said first end segment --.

Column 7,
Line 8, after the word “other” please change “f or” to correctly read -- for --.

Signed and Sealed this

Fifth Day of April, 2005

JON W. DUDAS
*Director of the United States Patent and Trademark Office*